US005165436A

United States Patent [19]

Hall, Sr. et al.

[11] Patent Number: 5,165,436

[45] Date of Patent: Nov. 24, 1992

[54] CRUTCH APPARATUS

[76] Inventors: James D. Hall, Sr.; Betty J. Hall, both of 923 Hollow Rd., Marion, Va. 24354

[21] Appl. No.: 852,401

[22] Filed: Mar. 16, 1992

[51] Int. Cl.[5] ..... A61H 3/02

[52] U.S. Cl. ..... 135/68; 135/71; 135/66

[58] Field of Search ..... 135/68, 71-73, 135/66, 76

[56] References Cited

U.S. PATENT DOCUMENTS

| | | | |
|---|---|---|---|
| 173,100 | 2/1876 | Lynch | 135/65 |
| 2,197,279 | 4/1940 | Thorssen | 135/72 X |
| 4,245,659 | 1/1981 | Schofner | 135/68 |
| 4,637,414 | 1/1987 | Urban | 135/73 |
| 4,763,680 | 8/1988 | Acosta, Sr. | 135/69 X |
| 4,793,370 | 12/1988 | Perez et al. | 135/65 X |
| 4,852,597 | 8/1989 | Mark et al. | 135/69 |
| 4,922,941 | 5/1990 | Daniels | 135/68 X |

FOREIGN PATENT DOCUMENTS

| | | | |
|---|---|---|---|
| 590652 | 8/1977 | Switzerland | 135/72 |

*Primary Examiner*—David A. Scherbel
*Assistant Examiner*—Lan Mai
*Attorney, Agent, or Firm*—Leon Gilden

[57] ABSTRACT

A crutch member includes spaced first and second legs joined at a lower distal end to a central support leg. A medial handle is positioned orthogonally between the first and second legs, with a swivel ring pivotally mounted orthogonally between the upper distal ends of the first and second legs.

4 Claims, 4 Drawing Sheets

CRUTCH APPARATUS

BACKGROUND OF THE INVENTION

1. Field of the Invention

The field of invention relates to crutch assemblies, and more particularly pertains to a new and improved crutch apparatus wherein the same utilizes a swivel ring mounted at the upper distal ends of the support legs for positioning, comfort, and convenience of a user thereof.

2. Description of the Prior Art

Various crutch apparatus of various types have been utilized in the prior art to accommodate individuals on a temporary and permanent basis due to disabling injury interfering with ambulatory activity of individuals. The comfort and positioning of an individual in the mounting of an individual relative to a crutch structure has heretofore been of concern in the utilization of crutch structure. U.S. Pat. No. 4,922,941 to Daniels sets forth an arm piece that is changeably mounted orthogonally relative to an upper distal end of the crutch legs.

U.S. Pat. No. 4,637,414 to Urban sets forth an arm piece arranged for cushioning mounted to an upper portion of a crutch assembly.

U.S. Pat. Nos. 4,852,597 and 4,763,680 are further examples of crutch structure arranged for adjustably mounting a medial support leg relative to spaced first and second legs.

As such, it may be appreciated that there continues to be a need for a new and improved crutch apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of crutch apparatus now present in the prior art, the present invention provides a crutch apparatus wherein the same is arranged to position a ring member at upper ends of spaced first and second legs of a crutch member for positioning and comfort of an individual in use of the crutch structure. As such, the general purpose of the present invention, which will be described subsequently in greater detail, is to provide a new and improved crutch apparatus which has all the advantages of the prior art crutch apparatus and none of the disadvantages.

To attain this, the present invention provides a crutch member including spaced first and second legs joined at a lower distal end to a central support leg. A medial handle is positioned orthogonally between the first and second legs, with a swivel ring pivotally mounted orthogonally between the upper distal ends of the first and second legs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved crutch apparatus which has all the advantages of the prior art crutch apparatus and none of the disadvantages.

It is another object of the present invention to provide a new and improved crutch apparatus which may be easily and efficiently manufactured and marketed.

It is a further object of the present invention to provide a new and improved crutch apparatus which is of a durable and reliable construction.

An even further object of the present invention is to provide a new and improved crutch apparatus which is susceptible of a low cost of manufacture with regard to both materials and labor, and which accordingly is then susceptible of low prices of sale to the consuming public, thereby making such crutch apparatus economically available to the buying public.

Still yet another object of the present invention is to provide a new and improved crutch apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
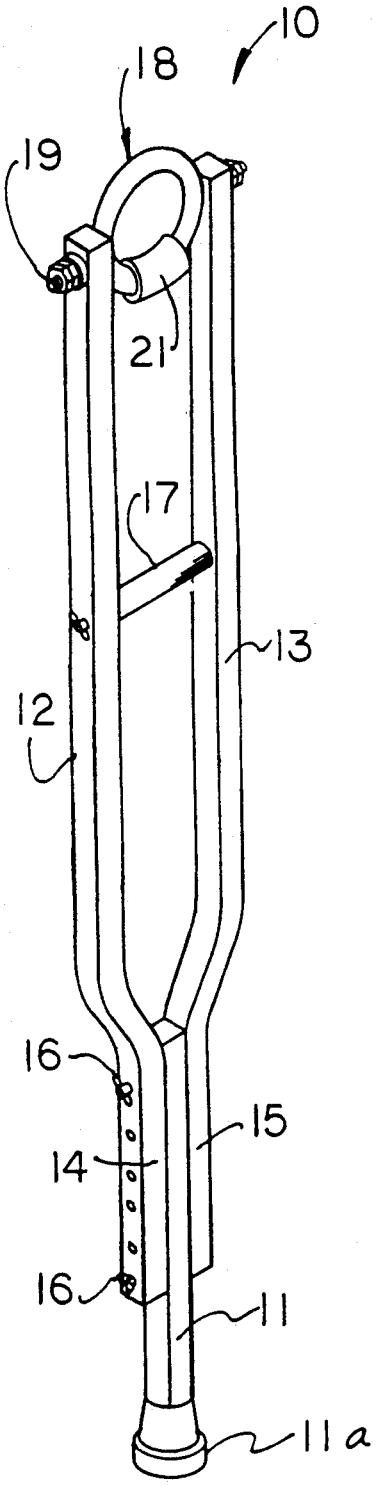
FIG. 1 is an isometric illustration of the instant invention.
Figure 2:
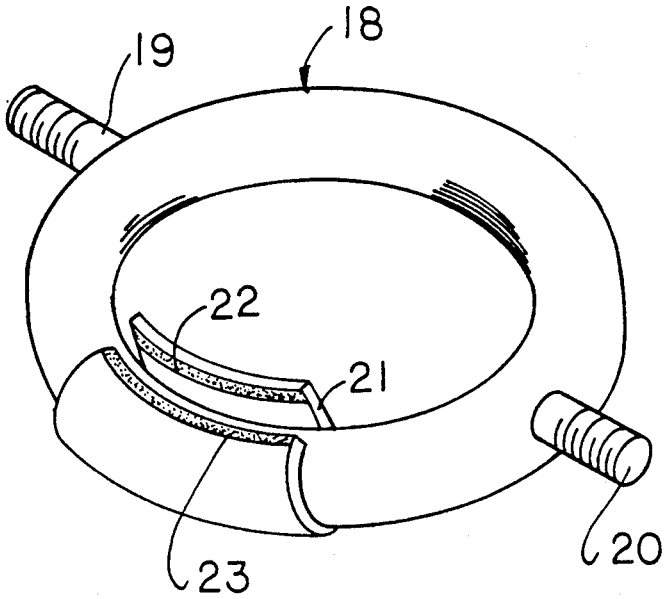
FIG. 2 is an enlarged isometric illustration of the ring structure.

With reference now to the drawings, and in particular to FIGS. 1 to 6 thereof, a new and improved crutch apparatus embodying the principles and concepts of the present invention and generally designated by the reference numeral 10 will be described.

More specifically, the crutch apparatus 10 of the instant invention essentially comprises a central support leg 11, including a resilient tip 11*a* at its lower distal end for enhanced frictional engagement within an underlying support surface. A first leg is spaced from a second leg, to include a first leg upper portion 12 spaced from and parallel a second leg upper portion 13, with the first leg upper portion 12 extending and canted towards the central support leg 11 along a first leg lower portion 14 about a first side of the central support leg 11, with a second leg lower portion 15 directed along a second side of the central support leg 11*a*. A plurality of fasteners 16 are orthogonally directed through the first and second leg lower portions 14 and 15, and the central support leg 11 to secure the assembly together. A lower handle 17 is orthogonally directed between the first leg upper portion 12 and the second leg upper portion 13, with an upper handle ring 18 pivotally mounted adjacent upper distal ends of the respective first and second leg upper portions 12 and 13. The upper handle ring 18 is formed of resilient shape-retentent polymeric material of a torrodial configuration receiving an individual's arm therethrough for enhanced comfort and convenience in use.

A cushion belt 21 is received about the ring 18 in a portion thereof between respective first and second axles 19 and 20 that are diametrically aligned through opposed sides of the ring 18 that each include respective first and second axle fasteners 25 and 26 to pivotally mount the respective first and second axles 19 and 20 through the respective first and second leg upper portions 12 and 13. The cushion belt 21 is positioned between the axles and is formed of resilient polymeric foam-like material for enhanced comfort under an arm portion of an individual. Respective first and second hook and loop fastener strips 22 and 23 are arranged at opposed ends of the fastener strip 22 for securement together in a selective manner about the ring 18.

Figure 4:
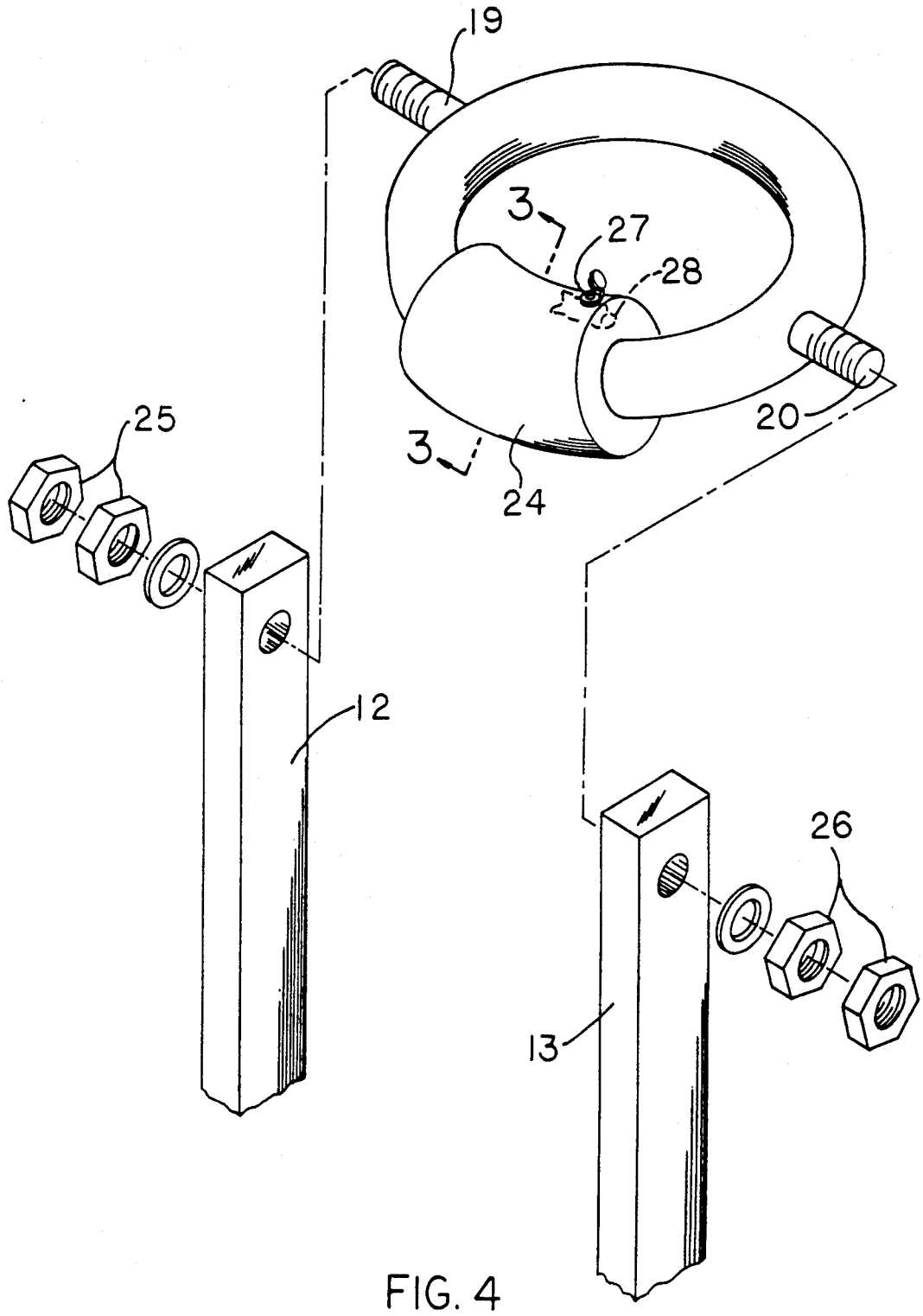
FIG. 4 is an isometric exploded view of the ring member utilizing a pneumatic tube member.

The FIG. 4 illustrates the use of a cylindrical inflation tube 24 utilized in lieu of the cushion belt 21. The cylindrical inflation tube 24 includes a plurality of adjacent pneumatic tubes 28 extending coextensively between opposed ends of the inflation tube 24 in communication with an inflation valve 27, wherein each of the pneumatic tubes 28 are in pneumatic communication relative to one another between interconnecting conduits 29 defined by a second diameter substantially less than a first diameter defined by the pneumatic tubes 28 to provide for pneumatic pressure within the tubes 28 to bleed into adjacent tubes to accommodate unequal weight distribution imparted to the inflation tube 24 by an individual.

Figure 5:
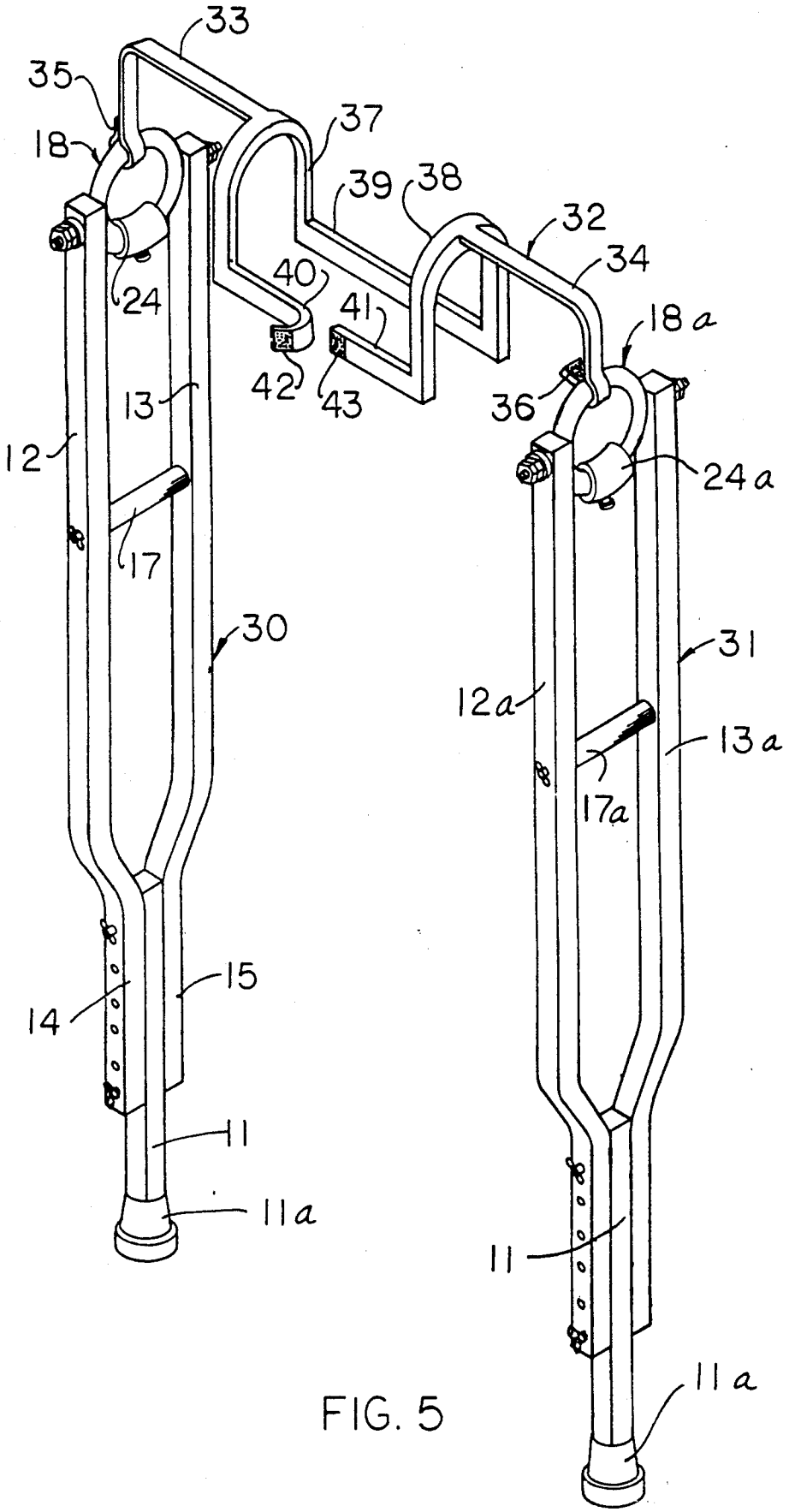
FIG. 5 is an isometric illustration of the crutch structure utilizing a torso harness.
Figure 6:
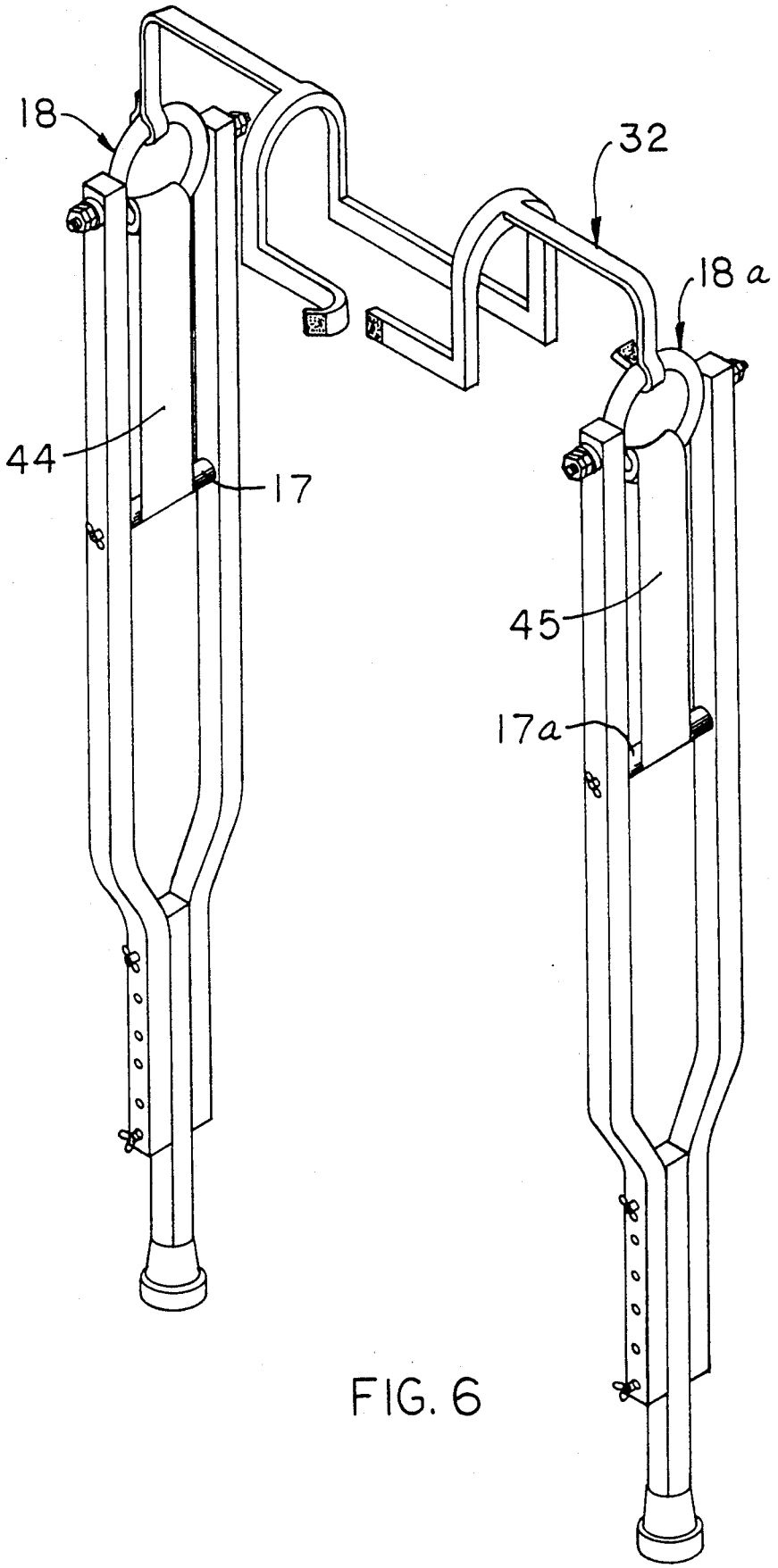
FIG. 6 is an isometric illustration of the invention utilizing a perspiration absorbing web relative to each crutch member.

The FIGS. 5 and 6 illustrate the use of first and second crutch members 30 and 31, wherein the second crutch member 31 utilizes parallel structure to include a second crutch first and second leg upper portion 12*a* and 13*a* respectively, a second crutch lower handle 17*a*, and a second crutch support leg 111.

Figure 3:
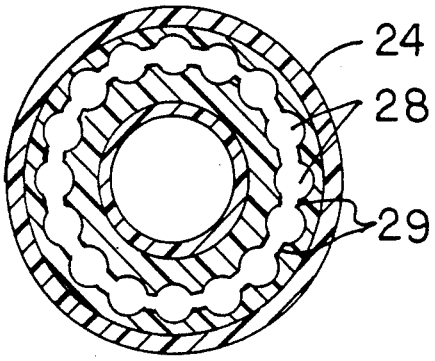
FIG. 3 is an orthographic view, taken along the lines 3—3 of FIG. 4 in the direction indicated by the arrows.

A torso harness 32 is provided and secured to the upper handle ring 18 and the second upper handle ring 18*a* diametrically opposed to the respective inflation tube 24 and second crutch inflation tube 24*a* of construction as set forth with reference to the FIGS. 3 and 4. The torso harness 32 inlcudes a first strap 33 and a second strap 34 mounted to the respective inflation tube 24 and second crutch inflation tube 24*a*, to include a respective first and second harness strap connector 35 and 36 mounted to respective first and second straps 33 and 34. A first "U" shaped shoulder strap 37 is medially intersected and integrally secured to the first strap 33, with a second "U" shaped shoulder strap 38 medially intersected by the second strap 34. A connecting band 39 is mounted to a lower distal end of the respective first and second "U" shaped shoulder straps 37 and 38, with a forward connecting first band 40 and a forward connecting second band 41 extending respectively from the respective first and second "U" shaped shoulder straps 37 and 38 and joined together by respective first and second band hook and loop connector portions 42 and 43 to encompass a torso portion of an individual in the positioning and mounting of the torso harness 32.

The FIG. 6 further includes the use of respective first and second fluid absorbent bands 44 and 45 extending from the inflation tubes 24 and 24*a* to the respective first crutch lower handle 17 and the second crutch lower handle 17*a* respectively. The fluid absorbent bands 44 and 45 accommodate perspiration and may be rotated relative to the inflation tube and lower handle in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crutch apparatus, comprising, a first leg spaced from and coextensive with a second leg, with a central support leg positioned between said first leg and said second leg extending downwardly therefrom, and a lower handle orthogonally directed between said first leg and said second leg above said central support leg, and an upper handle ring mounted orthogonally between said first leg and said second leg above said lower handle, said upper handle ring is of a resilient shape-retentive polymeric material of torroidal configuration, and including a first axle and a second axle, said first and second axles are diametrically aligned relative to said upper handle ring extending exteriorly of said upper handle ring, said first axle orthogonally directed through said first leg and mounted relative to said first leg, said second axle orthogonally directed through said second leg and mounted relative to said second leg, and an inflation tube mounted about the upper handle ring between the first axle and the second axle, wherein the inflation tube includes a plurality of coextensive pneumatic tubes directed within the inflation tube in surrounding relationship relative to the handle ring, wherein the pneumatic tubes include interconnecting conduits directed between the pneumatic tubes, wherein the pneumatic tubes are of a first diameter and the interconnecting conduits are of a second diameter less than the first diameter to effect metering of pneumatic pressure between the pneumatic tubes.

2. An apparatus as set forth in claim 1 including a second crutch member, with the second crutch member including a second crutch member first leg and a second crutch member second leg, with a second crutch member handle ring pivotally mounted between the second crutch member first leg and the second crutch member second leg in spaced relationship between the second crutch member first leg and the second crutch member second leg, and wherein the first and the second leg and the handle ring are mounted to a first crutch member, and a torso harness directed between the first crutch member and the second crutch member, and wherein the torso harness is secured to the handle ring and the second crutch member handle ring.

3. An apparatus as set forth in claim 2 wherein the torso harness includes a first strap secured to the handle ring and a second strap secured to the second crutch member handle ring, and a first inverted "U" shaped shoulder strap integrally and medially secured to the first strap, and a second inverted "U" shaped shoulder strap secured to the second strap medially of the second "U" shaped shoulder strap, and the first shoulder strap and the second shoulder strap include a rear connecting band orthogonally oriented between the first "U" shaped shoulder strap and the second "U" shaped shoulder strap, and a forward connecting first band spaced from the rear connecting band, wherein the forward connecting first band is secured to the first "U" shaped shoulder strap spaced from the rear connnecting band, and a forward connecting second band mounted to the second "U" shaped shoulder strap spaced from the rear connecting band, wherein the forward connecting first band and the forward connecting second band include connecting means for securement of the forward connecting first band and the forward connecting second band together.

4. An apparatus as set forth in claim 3 including a first fluid absorbent band rotatably wound about the handle ring and the lower handle, and a second fluid absorbent band rotatably wound about the second crutch member handle ring and the second crutch member lower handle.

* * * * *